United States Patent [19]

Dietrich

[11] 4,224,489

[45] Sep. 23, 1980

[54] SNAP ACTION SWITCH

[75] Inventor: Bernhard Dietrich, Eichenau, Fed. Rep. of Germany

[73] Assignee: Schaltbau Gesellschaft mbH, Munich, Fed. Rep. of Germany

[21] Appl. No.: 961,520

[22] Filed: Nov. 17, 1978

[30] Foreign Application Priority Data

Nov. 25, 1977 [DE] Fed. Rep. of Germany ..... 2752638

[51] Int. Cl.[3] ..... H01H 1/18; H01H 1/20; H01H 5/00

[52] U.S. Cl. ..... 200/76; 200/16 A; 200/67 AA; 200/241; 200/243; 200/275

[58] Field of Search ..... 200/16 A, 67 AA, 76, 200/159 R, 290, 241, 243, 275, 277, 280

[56] References Cited

U.S. PATENT DOCUMENTS

| | | | |
|---|---|---|---|
| 2,254,729 | 9/1941 | Bryant et al. | 200/76 X |
| 2,811,617 | 10/1957 | Townsend | 200/16 A X |
| 2,831,081 | 4/1958 | Mason | 200/277 X |
| 2,967,218 | 1/1961 | Dorjee | 200/76 |
| 3,230,322 | 1/1966 | Adams et al. | 200/16 A |
| 3,253,092 | 5/1966 | Landow | 200/280 X |
| 3,586,795 | 6/1971 | Mentel et al. | 200/16 A |

FOREIGN PATENT DOCUMENTS

| | | | |
|---|---|---|---|
| 1459667 | 10/1966 | France | 200/16 A |
| 345377 | 5/1960 | Switzerland | 200/277 |

*Primary Examiner*—Stephen Marcus

*Attorney, Agent, or Firm*—Smyth, Pavitt, Siegemund, Jones & Martella

[57] ABSTRACT

The snap action switch has a spring biased plunger carrying directly or indirectly at least one articulated contact carrier extending laterally from opposite sides of the plunger and having two convex contacts of cylindrical, semi-circular or prism configuration. These contacts cooperate with stationary contacts arranged in pairs and including at least two pairs with a total of four contacts arranged in a near-rectangle; the contacts of each pair are inclined to each other for defining a trough-like configuration for concurrent engagement with one of the contacts on the carrier. This way, a total of four contact make and break points is defined for a single current path.

11 Claims, 10 Drawing Figures

SNAP ACTION SWITCH

BACKGROUND OF THE INVENTION

The present invention relates to rapid action type switches, and more particularly, the invention relates to such switches with two contact make and break points per line connection to be made.

Snap action type switches are known in many configurations, whereby particularly the contact making and breaking for a single electric current path involves two stationary contacts cooperating with two movable contacts on a single bridge. See, for example, German printed patent applications Nos. 1,082,653; 1,169,009; 2,543,022, German Pat. No. 1,135,547 and U.S. Pat. Nos. 1,380,595 and 2,758,169.

The Swiss Pat. No. 385,963 discloses a snap action or quick throw type switch which is constructed to close one electrical circuit and open a second one in one operating state, while the situation is reversed in the opposite operating state. The switching action on each circuit involves two contact make or break points in order to increase the power that can be controlled by a single switch.

The British Pat. No. 1,114,630 discloses a quick action switch which includes means for forcing the contacts into an open position if the operating spring fails entirely or is to weak to open the contacts because, for example, the contacts are cold welded together. The U.S. Pat. No. 2,758,169 discloses a rapid action switch having two contact bridges only one of which at a time engages the stationary contacts. The contact surfaces of the respective other bridge in the open state is inclined relative to its stationary counter contacts.

Generally speaking, it should be realized that it is desirable to construct the switch for obtaining self-cleaning action of the contacts, that is to say, the contacts should slightly move across each other during engagement requiring resilient mounting of contacts. On the other hand, the switch should be amenable to opening by force other than the snap action in order to permit opening even if the snap action spring fails or the contacts are welded together. If the contact bridge or carrier is resilient forced opening is difficult to achieve.

DESCRIPTION OF THE INVENTION

It is an object of the present invention to provide a new and improved snap action switch having increased reliability providing for slight frictional engagement of the contacts and permitting forced opening.

In accordance with the preferred embodiment of the present invention, a new snap action switch is suggested whereby a single circuit path is closed through four contact points. Specifically, it is suggested to provide a snap action, spring biased plunger in which a contact carrier is articulated and extends laterally therefrom. The contact carrier has or is integral with two contacts, each of which being convexly contoured to face in different directions. These movable contacts (movable with the plunger) cooperate with stationary ones arranged in pairs whereby the contacts of each pair are inclined to each other and to a common switching plane extending at right angles to the plunger axis to define a trough-like configuration for engagement with one of the movable contacts.

The contact carrier mount is preferably of convex, calotte-shaped configuration and the contact carrier is either directly seated thereon or through a carrier member. The contacts of the carrier are either of cylindrical, semi-cylindrical or of other prism-like contour. The stationary contacts of each pair, for example, are bent off parts or vanes extending from a common carrier, whereby the two carriers of four stationary contacts, as cooperating with the two movable carrier contacts, are arranged in a common plane. Alternatively, the stationary contacts of a pair are of integral, V-shaped configuration or they are bent off different carriers. In either case, four stationary contacts are arranged in a rectangular, or near-rectangular configuration with one contact each of the two pairs being arranged in the common switching plane, the two resulting planes of contact making being inclined to each other and to the common plane which extends at right angles to the plunger axis and its direction of movement.

The articulated mounting of the contact carrier permits a tumbling motion so that for statistical reasons contact making involves initially almost always only two of the four stationary contacts, and each movable contact makes only one contact. This initial engagement is followed by a slight corrective pivot motion of the contact carrier to complete engagement with all four stationary contacts, whereby inevitable contact parts move across each other at a slight frictional movement, thereby obtaining self-cleaning of the contact surfaces. Moreover, the contact carrier may be a rigid one permitting forced opening without requiring resiliency as between contacts and engagement of the force for a forced opening.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Proceeding now to the detailed description of the drawings, FIG. 1 illustrates a snap action switch in which all movable parts are carried by a plunger 1. The plunger 1 is provided with recesses such as 5, which receive one end each of two springs 3 whose respective outer ends are held in arms 4, which, in turn, extend from a push button 2. The plunger 1 is suitably guided and slidably held in a housing (not shown).

Figure 1:
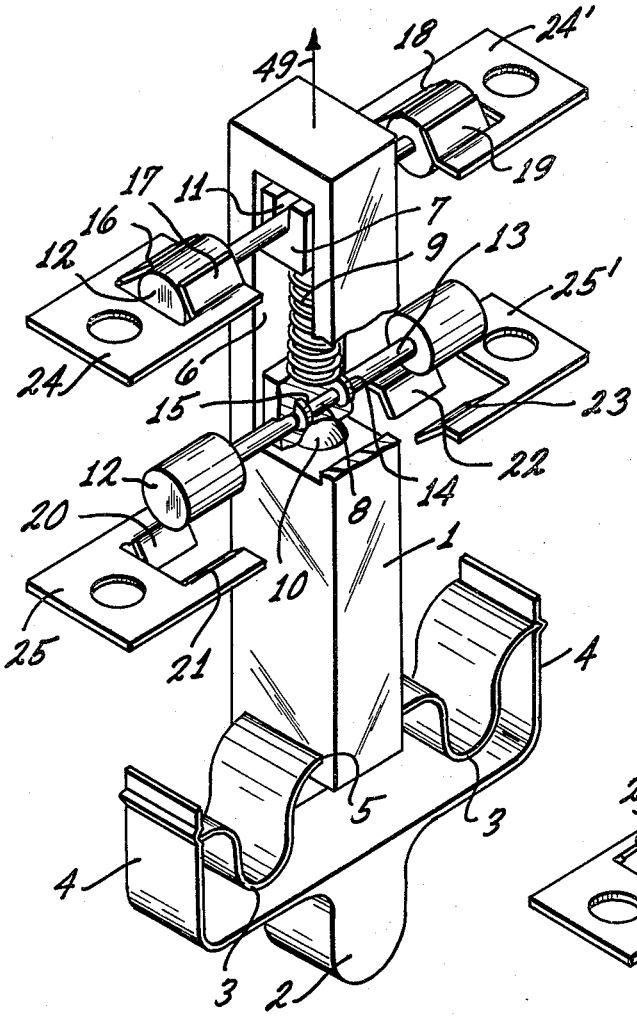
FIGS. 1, 2 and 3 each are perspective views of snap action switches in accordance with the preferred embodiment using similar movable contact portions but different configurations for the stationary contacts.

Plunger 1 has a slot 6 adjacent to its other end which contains two support members 7 permitted to slide in the slot. The opposite ends of slot 6 are provided with or are configured as calotte-shaped, or dome-shaped, bearings 10 (the upper one is not visible), and the members 7 have matching concave recesses 8 to be mounted on the calottes 10. A spring 9 urges the two members 7 apart and against these convexities 10.

Each of the members 7 is provided with a deep recess or cut and receives, respectively, an arm 13 of one of two dumbbell-like contact bridges or contact carriers. These contact bridges or carriers each have two contacts 12 of cylindrical configuration, whereby the cylinder axes are coaxial to each other and to the axis of the respective arm 13. The cylindrical contour of the contacts 12 defines in each instance a contact that faces in different directions in a plane that runs parallel to the plunger axis 49 as well as parallel to the dumbbell axis. The contacts are shown to have circular cylindrical configuration, but other configurations of rotational symmetry can be employed as well. Moreover, each dumbbell is electrically conductive in its entirety.

Clamping rings 14 prevent each assembly 13, 12 from axial displacement in the respective carrier member 7. These snap rings or clips are situated in annular recesses 15 at the respective slots 11. Due to the particular mode of mounting the dumbbell may pivot on axes transversely to the plunger axis (being vertical in FIG. 1). Of course, the mounting of carrier members 7 limits the range of pivoting. In either case, the carrier members are articulated for a tumbling motion out of the plane transversely to plunger axis 49.

Reference numeral 24, 24' refer to two upper stationary contact carriers, and reference numerals 25, 25' denote analogously two lower ones of such carriers. The carriers or terminals 24, 24' are situated and define a first, upper plane, and carriers or terminals 25, 25' define a second lower plane extending parallel to the upper one. Both planes extend at right angles to the direction of displacement of the plunger 1, axis 49. Each carrier or terminal carries two integral contacts which extend at an angle to each other and out of the respective carrier plane.

Specifically, stationary carrier 24 has two upwardly bent contacts 16 and 17, and contacts 18, 19 pertain analogously to the companion carrier 24'. Contacts 20 and 21 are bent down from carrier 25, so are contacts 22 and 23 relative to carrier 25' and the lower plane. All these contacts cooperate specifically with the dumbbell contacts whereby each contact pair on a stationary carrier has an tangential disposition to the respective cylinder which they are to engage for contact making.

From a different point of view, each dumbbell having two cylindrical contacts 12, cooperates with four contacts such as 16 through 19; of these respective two are arranged in a common plane (17, 19 and 16, 18) defining two mutually inclined planes accordingly being symmetrically inclined to a plane that extends at right angles to the plunger axis 49. As to the latter plane, one can also say that the four contacts 16 to 19 are arranged in a near rectangle, traversed in its center by the plunger axis. For reasons of tolerances, this rectangle may be slightly distorted into a trapezoidal configuration. The significance of that aspect will be discussed below.

It will be appreciated that the inventive concept has been realized twice in this configuration, once for each dumbbell and circuit. In the illustrated position and operational state of the switch, the upper dumbbell contacts engage the contacts 16 through 19 while the lower dumbbell contacts are held above the stationary contacts 20 through 23. Accordingly, carriers or terminals 24 and 24' are electrically interconnected through the upper dumbbell, while terminals or carriers 25, 25' are disconnected from each other. Upon pushing button 2 up, the springs 3 pull plunger 1 down so that the upper dumbbell contacts disengage from the contacts 16 to 19, while the lower dumbbell contacts engage the contacts 20 to 23, and carriers 25 and 25' have been interconnected.

Figure 2:
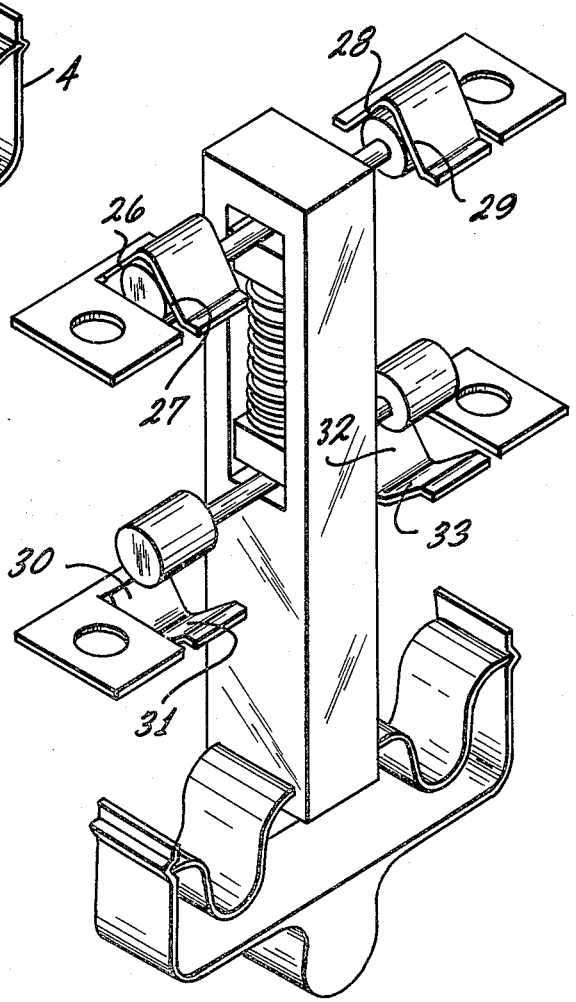

FIG. 2 illustrates a switch in which the movable elements (plunger, dumbbells, etc.) are similar to FIG. 1, but the stationary contacts 26 to 33 differ. The stationary contacts are of V-shaped configuration and are integrally dependent from the respective carrier by one arm of the V. The respective other arm is unrestrained to provide for resilient reaction and contact pressure. Nevertheless, each of the four contact carriers is provided also here with two contacts forming the V, and engaging the respective dumbbell cylinder tangentially. Thus, as to each switching plane, there are provided also here four contacts arranged in pairs in common inclined planes and delineating rectangles.

It should be noted that FIGS. 1 and 2 have in common that each carrier has two contacts which are always electrically interconnected, and the electrical connection when made runs from these contacts into one cylinder, through the dumbbell arm to the other cylinder which, in turn, engages two permanently interconnected contacts. The situation is different in FIG. 3.

The FIG. 3 illustrates again the same type of plunger including the carrier members in the upper state. However, the dumbbell contacts may differ, not in geometric configuration, but electrically. The dumbbell arms 48 may be made of electrically insulating material and separate electrically the contact-making cylinders such as 51 and 52 of the upper dumbbell; the lower one is analogously constructed.

The stationary contacts are constructed as follows. A flat contact carrier and terminal such as 46 is provided with a bar or arm 42 from which extend contacts 36, 37, spaced axially along the arm extension but extending in the same plane which is obliquely oriented to the carrier plane. Arm or bar 42 electrically interconnects contacts 36 and 37 on a permanent basis. In the contact making state (as shown) contacts 36 and 37 engage the two separated movable, cylindrical contacts 51 and 52.

Analogously, a second carrier 47 on the other side is provided with a connecting arm or bar 43 and carries accordingly two contacts 34, 35 which also extend in the same plane. These contacts 34 and 35 engage the contacts 51 and 52. Thus, a connection is made from contact 36 via contact 51 to contact 34, and a second, parallel connection is made between contacts 35 and 37 via contact 52.

This particular configuration, therefore, permits contact making and through connection without involvement of the dumbbell arm 48. The two arms 43 extending on opposite sides of the plunger provide for the current paths in the case contact has been made. Again, the concept of four contacts arranged in a rectangle or near rectangle, has been realized except that the permanent connection of contacts is different. One can also make the dumbbell electrically conductive to establish a third current path.

The lower portion of this assembly is analogously constructed, having stationary contacts 38 through 41 of which contacts 40 and 41 are interconnected by bar or arm 45 and contacts 38 and 39 are interconnected by bar 41. The lower dumbbell cooperates with these contacts analogously in the lower disposition of the plunger 1.

After having described three slightly different configurations for the stationary contacts, specifics of the contact making applicable to all instances shall be described. If prior to and during contact making dumbbell arm 13 or 48 is misaligned by being pivotally displaced about axis 49, the dumbbell contacts 12 or 51 and 52 may first make contact with but two contacts, e.g. with contacts 34 and 37 in FIG. 3. No electrical through connection is made therewith if arm 48 is insulated; otherwise a connection is made already. The plunger being urged upwardly by the springs 3 will cause the dumbbell to straighten by a slight rotation about plunger axis 49 to thereby complete contact making engagement with the other two contacts 35 and 36, almost simultaneously for both contacts. If, for any reason the dumbbell is pivoted about axis 50, e.g. counterclockwise, stationary contacts 35 and 37 will make contact first with dumbbell contact 52, and the retaining action of this engagement in conjunction with continued upward movement of the plunger pivots the dumbbell clockwise so that soon contacts 34 and 36 are interconnected by the dumbbell contact 51.

It can thus be seen that irrespective of any angular displacement of the dumbbell, a single path connection will exist for a very short time only, if at all. In view of the promptly produced position correction, one can even make the arm 48 of electrically conductive material so that in the first case of misalignment (pivoting about axis 49) a connection may run, e.g. from 34 to 51 through 48 to 50 to 37.

It can readily be seen that contact will be made by the contacts almost always slightly sequentially. This sequence of contact making is accompanied by a corrective alignment motion of the dumbbell, being made possible by the articulated mount of the dumbbell carriers 7 on the calottas 10. Permitting misalignment is intentional as it will inevitably result in a corrective motion between initially engaging contact parts to obtain thereby a slightly abrasive, self-cleaning action of the frictionally engaging contact surfaces. Moreover, the initial misalignment can be expected to vary from time to time so that all contact surfaces participate in this action at one time or another. This is a matter of statistics. This effect is, moreover, enhanced if the stationary contacts are not quite arranged in the corners of a rectangle, but if that quadrilateral is slightly trapezoidally distorted. Simple manufacturing tolerances may well suffice to obtain that contour, because a particularly accurate trapeze is not needed. Decisive is that for reasons of intentional irregularities the four point contact making for a single through connection is established sequentially at varying sequences to obtain self-cleaning action of all contacts during use.

Figure 3:
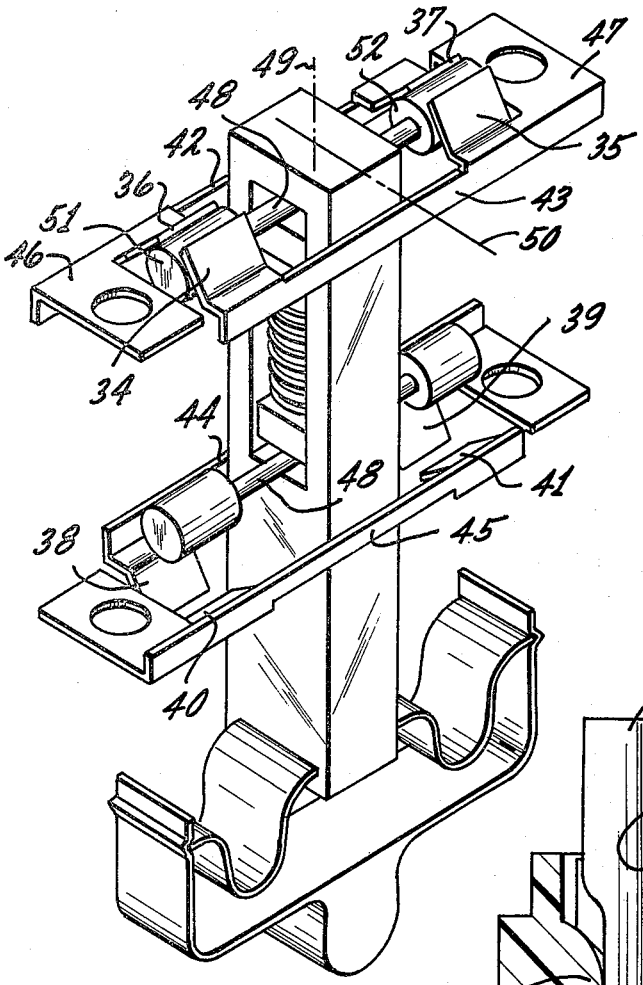

A review of FIGS. 1, 2 and 3 reveals that in cases a single dumbbell may suffice, provided the travel path of the plunger is sufficiently large so that the single dumbbell may cooperate for contact making either with the upper set of stationary contacts or with the lower set, while the upper and lower sets of stationary contacts are sufficiently spaced in the vertical direction.

FIGS. 4 through 10 illustrate different configurations for the movable contact, the stationary contacts are not shown here, but it will be appreciated that any of the stationary contact configurations of FIGS. 1, 2 and 3 can be used. The FIGS. 4 and 5 for instance show also a plunger 76 having a slot, and an end portion having recesses 5' for receiving the snap action springs such as 3 in FIG. 1, 2 or 3. The slot receives carrier members 55 and 56 being spread apart by a spring 77, and respectively supporting contact members 53 and 54. Each carrier member 55, 56 has also a concave recess for articulation on convex mounts 75.

Each of the contact members 53 and 54 can also be described as being of integral construction, each having contacts which are combined with a contact carrier. They are generally of triangular cross-section and constitute prisms with a triangular base. In each instance, a sheet has been folded into a split tube-like configuration. Snap tongues 57, 58 hold the contact 53 in the carrier member 55, and snap tongues 59, 60 hold contact 54 in member 56, the carrier members being provided with suitable recesses accordingly. These tongues may be integral with the members 53, 54 and prevent particularly lateral displacement of each of the contact members.

The split tube-like contacts 54, 55 cooperate with stationary contacts of the type above, whereby the curved sides of the contacts 53, 54 engage the contact vanes such as 16 through 23 in more or less parallel relation. Engagement with the V's of FIG. 2 or with the vanes of FIG. 3 is an analogous one.

Figure 5:
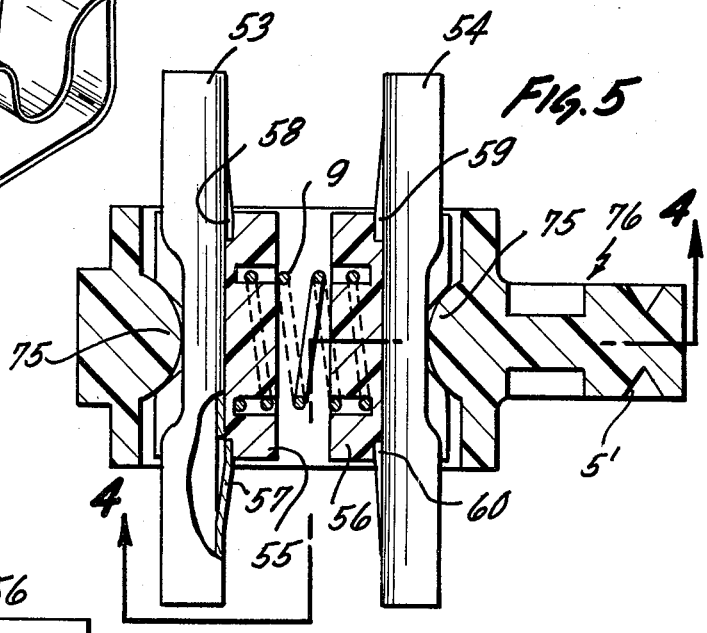
Figure 4:
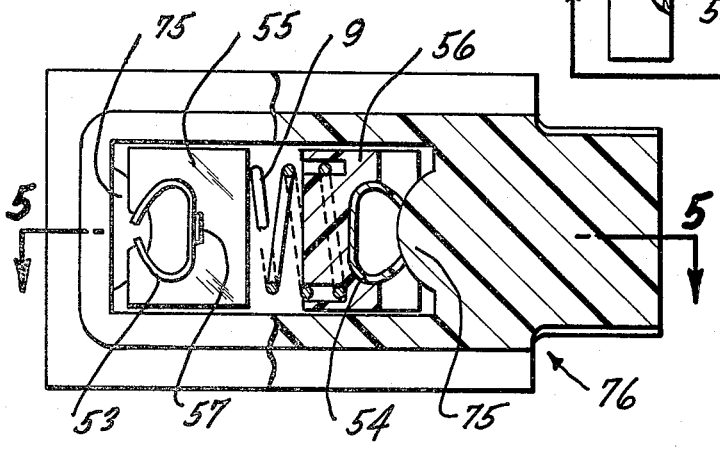
FIGS. 4, 6 and 8 are side views of different movable contact arrangements, shown respectively in cross-section in FIGS. 5, 7 and 9.
Figure 6:
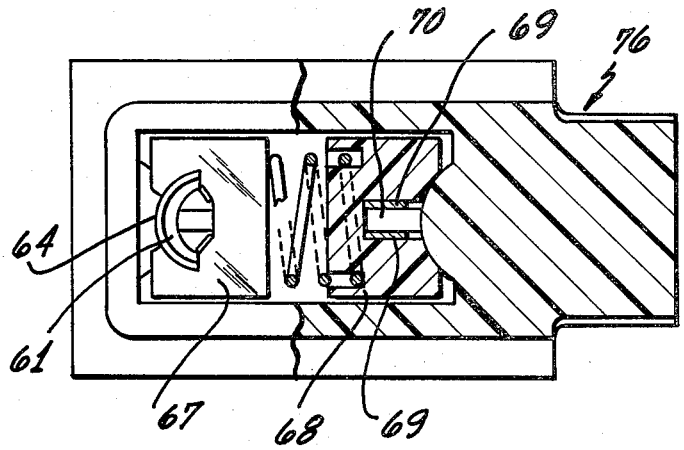
Figure 7:
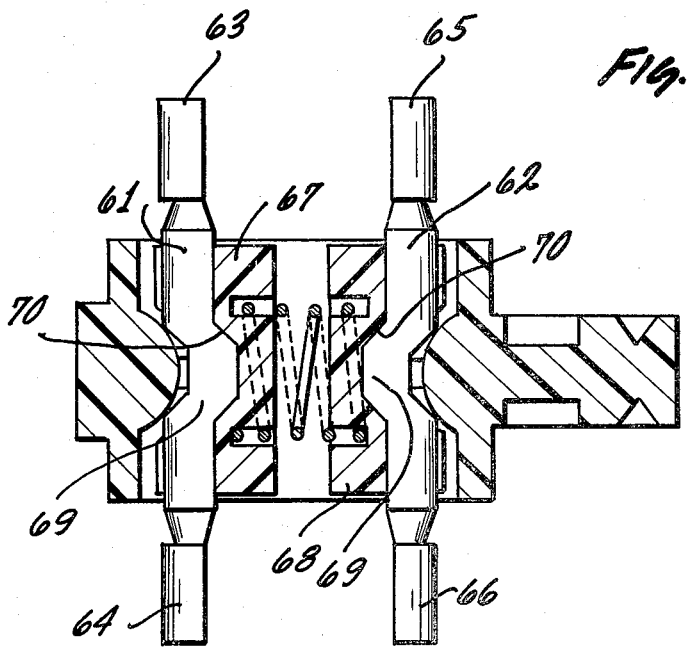

The plunger configuration in FIGS. 6 and 7 is similar to the one of FIGS. 4 and 5, but carrier members 67, 68 are configured slightly differently. The movable contacts in this case include punched parts 61, 62 of U-shaped cross-section serving as contact carriers and bridges. The ends are simi-circularly deformed at slightly larger radius of curvature to establish the contacts 63 through 66. These contacts cooperate with stationary contacts just like the cylindrical dumbbell contacts (supra).

The contact carriers 61 and 62 are provided with integral noses 69 for engaging recesses 70 in the carrier members 67 and 68 to prevent lateral slippage of the contacts.

Figure 8:
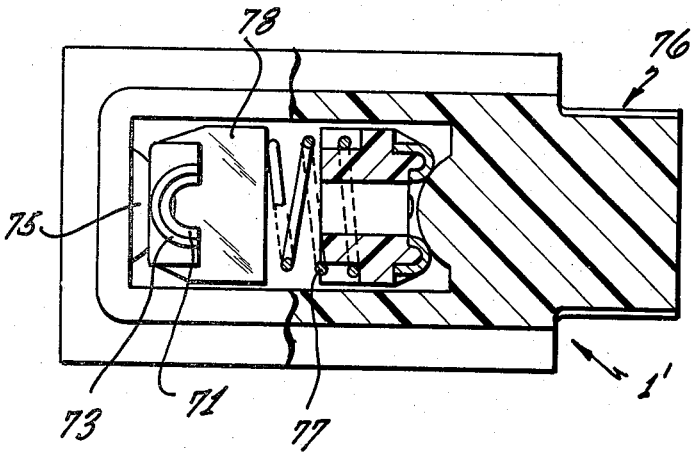
Figure 9:
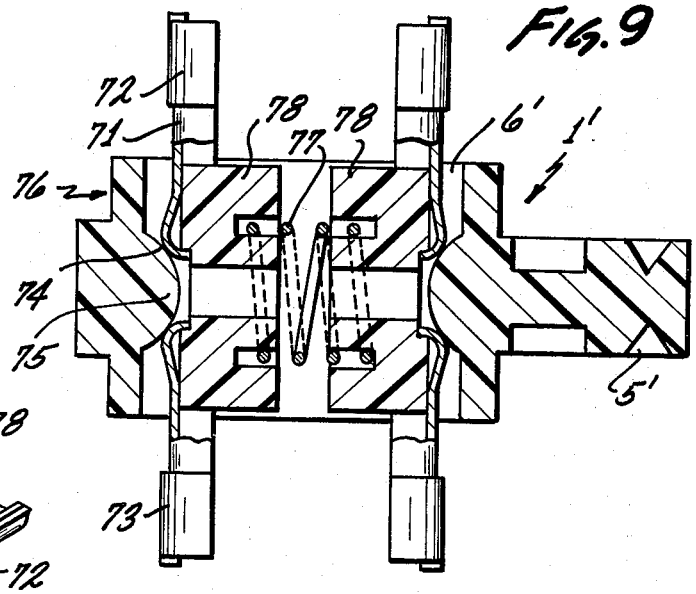
Figure 10:
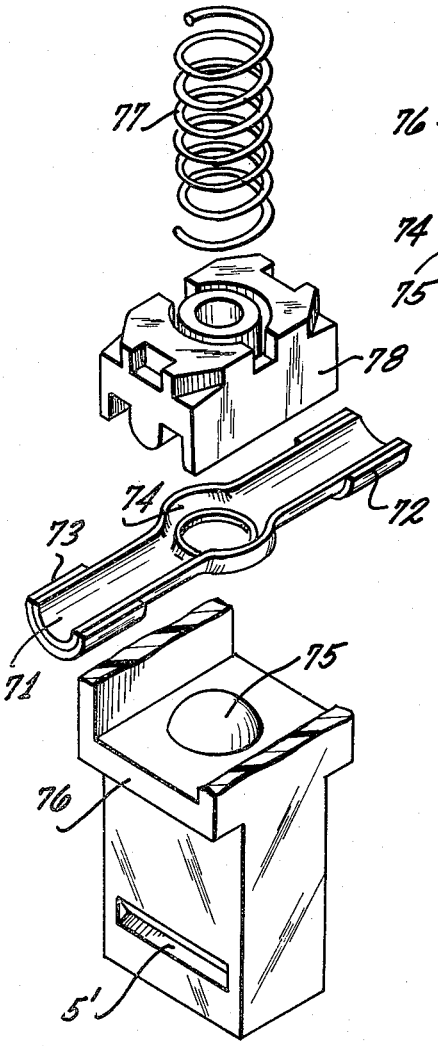
FIG. 10 is a perspective exploded view of the assembly shown in FIGS. 8 and 9.

FIGS. 8 through 10 show a still similar plunger 76 with a recess and calotte-shaped bearing portions 75. Two contact carriers and bridges 71, each having a central circular aperture 74, are directly held therewith and articulated on these bearings 75. They are spaced from each other by means of insulating members 78 which, in turn, are spread apart by spring 77.

Each metal contact carrier 71 is of semi-circular cross-section and carries similarly contoured contacts 72 and 73. The contact carriers are strips which have been shaped into the illustrated contour. The lip of aperture 74 as engaging the bearings 75, prevents directly lateral displacement of the contact carriers. The semi-cylindrical contacts 72 and 73 cooperate with stationary contacts as described.

The choice of the specific type of contacts and contact bridges is dictated primarily by cost considerations and ease of manufacturing. In either case, they must be sufficiently thick to be rigid and to permit the conduction of current at a low electrical resistance. Preferred is further a convex contour of the individual contacts on the carrier or bridge to cooperate with two flat differently oriented stationary contacts. This convexity, achieved in all movable contacts, defines two contact making surfaces for each contact facing generally in different directions in a plane that extends parallel to the plunger axis 49 as well as to an axis (50) being at right angles to the plunger axis and the contact carrier axis.

The invention is not limited to the embodiments described above but all changes and modifications thereof not constituting departures from the spirit and scope of the invention are intended to be included.

I claim:

1. Snap action switch, comprising:

a spring-biased plunger movable in a first, longitudinal direction;

at least one contact carrier, extending laterally from the plunger in opposite directions and having two contacts respectively arranged on the carrier on opposite sides of the plunger and along an axis at right angles to said first direction, each contact having first and second surface portions respectively facing in different directions, these directions being located in a plane extending parallel to said first direction as well as to a direction at right angles to said first direction, said plane further extending at right angles to said carrier axis;

a plurality of stationary contacts arranged in pairs and including at least two pairs, the two pairs being respectively arranged adjacent to said two contacts with a total of four contacts arranged in a near-rectangle, the contacts of each pair being inclined to each other, defining a trough-like configuration respectively for concurrent engagement with one and the same of the contacts on said carrier, whereby the different directions, in which the said surface portions of the respective contact face, are oriented respectively at right angles to contact surfaces of the stationary contacts of the respective pair:

a convex calotte-shaped mount in the plunger; and means for articulating the contact carrier on the calotte-shaped mount, for permitting the contact carrier to undergo a turning motion on an axis in said first direction.

2. Switch as in claim 1, the contacts of each pair being established by bent-off vanes of, and extending from, a stationary contact carrier, the two stationary contact carriers of the two pairs being arranged in a common plane.

3. Switch as in claim 1, the contacts of each pair being integral and being configured to have a V-shaped contour.

4. Switch as in claim 1, one contact of each pair being interconnected by a bar, there being two bars accordingly arranged parallel to said carrier axis and to both sides of the plunger.

5. Switch as in claim 1, said contacts and contact carrier being of dumbbell-like configuration, the contacts of the carrier being cylindrical.

6. Switch as in claim 1, said contact and contact carrier being integral of prism cross-section.

7. Switch as in claim 1, said contact carrier having a U-shaped profile, the contacts on the carrier being curved pieces at the ends of the carrier.

8. Switch as in claim 1, said plunger having an opening, said contact carrier having been in said plunger opening and having a circular opening and being seated on said mount, and means for urging the contact carrier onto said mount.

9. Snap action switch as in claim 1, having a second, similar contact carrier cooperating with four similar stationary contacts and being articulatedly mounted on the plunger.

10. Switch as in claim 1, said plunger having an opening, a carrier member displaceably mounted in said opening and carrying said contact carrier and spring means for urging the carrier member against said mount.

11. Switch as in claim 10, including means for retaining the contact carrier in the carrier and preventing displacement along the carrier axis.

* * * * *